US007014172B2

(12) United States Patent
Kataoka

(10) Patent No.: US 7,014,172 B2
(45) Date of Patent: Mar. 21, 2006

(54) ELECTRIC HOIST

(75) Inventor: Kouzo Kataoka, Osaka (JP)

(73) Assignee: HHH Manufacturing Co., (JP)

( * ) Notice: Subject to any disclaimer, the term of this patent is extended or adjusted under 35 U.S.C. 154(b) by 182 days.

(21) Appl. No.: 10/485,903

(22) PCT Filed: Jun. 20, 2003

(86) PCT No.: PCT/JP03/07895

§ 371 (c)(1),
(2), (4) Date: Feb. 4, 2004

(87) PCT Pub. No.: WO2004/056689

PCT Pub. Date: Jul. 8, 2004

(65) Prior Publication Data

US 2005/0230670 A1 Oct. 20, 2005

(30) Foreign Application Priority Data

Dec. 19, 2002 (WO) ..... PCT/JP02/13288

(51) Int. Cl.
*B66D 1/36* (2006.01)

(52) U.S. Cl. ..... 254/338

(58) Field of Classification Search ..... 254/286, 254/336, 338

See application file for complete search history.

(56) References Cited

U.S. PATENT DOCUMENTS 782,103 A * 2/1905 Bruner ..... 242/157.1
3,899,083 A * 8/1975 Flessner et al. ..... 212/274
4,151,981 A * 5/1979 Gennep ..... 254/336
4,575,050 A * 3/1986 Bechmann ..... 254/286
4,600,177 A * 7/1986 Fritz ..... 254/338
4,887,325 A * 12/1989 Tesch ..... 5/84.1
6,023,862 A * 2/2000 Sirjola ..... 37/397
6,062,405 A * 5/2000 Pech et al. ..... 212/298
6,241,215 B1 6/2001 Gersemsky et al.
6,250,486 B1 * 6/2001 Enoki ..... 212/322

(Continued)

FOREIGN PATENT DOCUMENTS

JP S63-48800 9/1988

(Continued)

OTHER PUBLICATIONS

Bada product catalog (Oct. 2002).

*Primary Examiner*—Emmanuel Marcelo
(74) *Attorney, Agent, or Firm*—Thompson Hine LLP

(57) ABSTRACT

The present invention is to provide an electric hoist using a suspended electric winch that maintains a horizontal posture in any cargo handling operation. A hoist in one aspect includes a winch including a drum axially connected to a drive shaft of a motor, a suspension hook attached to the winch above the center of gravity of the winch that is in a horizontal posture thereof in and empty load state thereof, a first roller arranged on the opposite side of the winch from the suspension hook and turning the direction of a wire paid out from the drum toward the center of gravity, and a second roller for turning the direction of the wire to be aligned with a vertical line downward extended from the center of gravity of the winch. The winch is suspended in the simplest suspension method when the winch is used as a hoist. The suspension method is implemented in many plants and warehouses without any particular facility. The winch in the suspended posture thereof is balanced in a fore-after direction and a lateral direction, and continuously maintains a horizontal aligned posture during a load empty period and a load raising and lowering period.

9 Claims, 8 Drawing Sheets

U.S. PATENT DOCUMENTS

| | | | | |
|---|---|---|---|---|
| 6,631,816 | B1 * | 10/2003 | Miyazawa et al. | 212/272 |
| 2004/0251455 | A1 * | 12/2004 | Mangin | 254/285 |

FOREIGN PATENT DOCUMENTS

| | | |
|---|---|---|
| JP | H1-242396 | 9/1989 |
| JP | H2-46518 | 10/1990 |
| JP | H7-117992 | 5/1995 |
| JP | H7-43117 | 10/1995 |
| JP | H11-79687 | 3/1999 |
| JP | 2002-528365 | 9/2002 |

* cited by examiner

ELECTRIC HOIST

FIELD OF THE INVENTION

The present invention relates to an electric hoist for raising and lowering a heavy load in a cargo handling operation, and has, as a major component, an electric winch that is constantly suspended in a horizontally aligned posture thereof.

BACKGROUND OF THE INVENTION

Electric winches typically have a relatively simple structure in which a drum is coupled to a drive shaft of an electric motor such as a geared motor through a reduction device. A variety of types of electric winches are commercially available in wide ranges of price and performance.

A BADA product catalog issued by ZHENJIANG BADA MECHANICAL & ELECTRICAL CO., LTD. in October 2002 discloses a heavy load lifting hoist using an electric winch. FIG. 8 illustrates the disclosed structure. A horizontal extending arm 51 is connected to a vertically aligned pole 50 and an electric winch 52 is supported on the arm 51. A clamp 54 having a socket 53 is fixed to the pole 50. A wedge 55 is welded to one end of the arm 51. With the wedge 55 received in the socket 53, the arm 51 is secured to the pole 50. The other end of the arm 51 is supported by a brace 56. A cover frame 57 covers the electric winch 52. Arranged on the cover frame 57 are two brackets 58 through which the arm 51 extends. The electric winch 52 is supported by the arm 51 with the arm 51 extending through the brackets 58.

The electric winch 52 is used as a hoist in this structure that a wire 60 (alternatively, a rope or a chain) wound around a drum 59 is suspended. The electric winch 52 supported by two brackets 58 is free from being inclined during lifting of a heavy cargo. In view of safety cargo handling operation, an uninclined electric winch 52 is important to maintain an appropriate positional relationship between the wire 60 and the drum 59 and to prevent the wire 60 from being wound on the drum 59 on a one-sided manner and from being unwound unintentionally from the drum 59.

The pole 50 in the conventional art must be erected if the electric winch 52 is used in a cargo handling operation within a plant building or warehouse. Since the pole 50 is not permanently installed, the area that permits the pole 50 to be erected is limited. It is not practical to newly erect the pole 50 within a plant building or a warehouse. If the arm 51 is secured to the ceiling of a building, the pole 50 is dispensed with. Even in this case, the area that permits the arm 51 to be installed is also limited.

A simplest fixing method of the electric winch 52 is to suspend it. More specifically, the electric winch 52 is easily suspended as an electric hoist if a suspension tool such as a wire is available in a cargo handling place.

FIG. 9 illustrates such an example. A hook 61 is arranged on the electric winch 52. The hook 61 is secured to the electric winch 52 at the center of gravity thereof in an empty load condition. By hanging the hook 61 on a wire 62 that is suspended from an appropriate posture on the ceiling, the electric winch 52 remains in a horizontal posture thereof. The electric winch 52 includes the motor and drum side by side. During cargo lifting, a load acts on the drum causing the center of gravity of the entire electric winch 52 to be shifted toward the drum. The electric winch 52 is thus inclined downward at the drum 59 in response to the weight of the load. If the cargo handling operation is performed with the electric winch 52 inclined, the wire 60 may be wound in a one-sided fashion on the drum 59. Such an operation is dangerous. Since the load is varied in weight, it is impossible to set the position of the hook 61 to the center of gravity during cargo operation.

SUMMARY OF THE INVENTION

Accordingly, it is an object of the present invention to provide an electric hoist as a suspended electric winch that maintains a horizontal posture in any cargo handling operation.

An electric hoist of the present invention in one aspect includes an electric winch including a drum axially connected to a drive shaft of a motor, a suspension hook attached to the electric winch right above the center of gravity of the electric winch, the electric winch being in a horizontal posture thereof in and empty load state thereof, a first roller arranged on the opposite side of the electric winch from the suspension hook and turning the direction of a wire paid out from the drum toward the center of gravity, and a second roller for turning the direction of the wire to be aligned with a vertical line downward extended from the center of gravity of the electric winch. The hook for suspending the electric winch may be a ring. The hook may be directly secured to the electric winch or to the cover frame already discussed in the Description of the Related Art. The wire paid out from the drum is wrapped around the first roller along about the lower half circumference thereof and wrapped around the second roller along about the upper half of the circumference thereof. The wire thus runs to be aligned with a line vertically downward extending from the center of gravity of the electric winch (right below the position of the hook). As a result, the center of gravity of the electric winch in the suspended electric winch and the center of gravity of the load are in alignment. Regardless of whether the electric winch is in an empty load condition or a loaded condition, the hoist remains to be laterally balanced.

The roller may be a round shaft having a predetermined length. The wire is thus directly wrapped around the shaft. A method for securing the roller to the electric winch is not limited to any particular means. The rotatably supported shaft allows the wire to be paid out and wound up in a smooth manner and reduces friction between the shaft and the wire.

The roller may include a sheave fixed to the shaft. The wire is wrapped around the sheave. If the wire is directly wrapped around the shaft, the wire may slip along the length thereof during the cargo handling operation. The use of the sheave fixed to the shaft is preferable. The shaft may be rotatably supported (with the sheave integrally rotatable with the shaft). The advantage of this arrangement has already been discussed.

The sheaves of the first roller and the second roller are shifted in the fixed positions thereof along the longitudinal direction of the shafts. By shifting the sheave of the second roller to the vertically aligned line extending from the center of gravity, the wire is suspended downward right below the center of gravity of the hoist. As a result, the hoist is balanced in a fore-aft direction and is not inclined in the fore-aft direction during an empty load period and a loaded period. This arrangement allows the electric hoist to more smoothly lift a load.

If the fixing positions of the sheaves are shifted between the first roller and the second roller, the wire is stretched between the sheaves at an inclination. As a result, the wire touches and bends at the flange of the sheave other than the groove of the sheave, thereby causing excessive friction there. A cargo handling operation for a long period of time in this condition may lead to a broken wire.

To avoid such a problem, the wire stretched between the sheaves must be clear of the flange of the sheaves. In accordance with the present invention, the sheaves of the first and second rollers are aligned at the same angle as the wire stretched between the sheaves. This arrangement is achieved by inclining the rotary shaft of the sheave. The wire stretched between the sheaves is correctly aligned to the groove of each sheave.

One of the two sheaves of the first and second rollers for running the wire in the vertically downward direction may be rotatably supported around the rotary shaft thereof. The sheave rotates following the wire which could be moved when the load rolls and pitches. The winding position of the wire along the sheave is appropriately maintained.

In this arrangement, the shaft of the sheave is inclined in a manner such that the shaft is at a right angle with respect to the wire. The wire is thus aligned with the groove of the sheave. In the same way as the cylindrical shaft is inclined, the winding position of the wire is correctly aligned. The wire is prevented from being cut or damaged due to the rubbing of the wire against the flange of the sheave.

DESCRIPTION OF THE PREFERRED EMBODIMENTS

Figure 1:
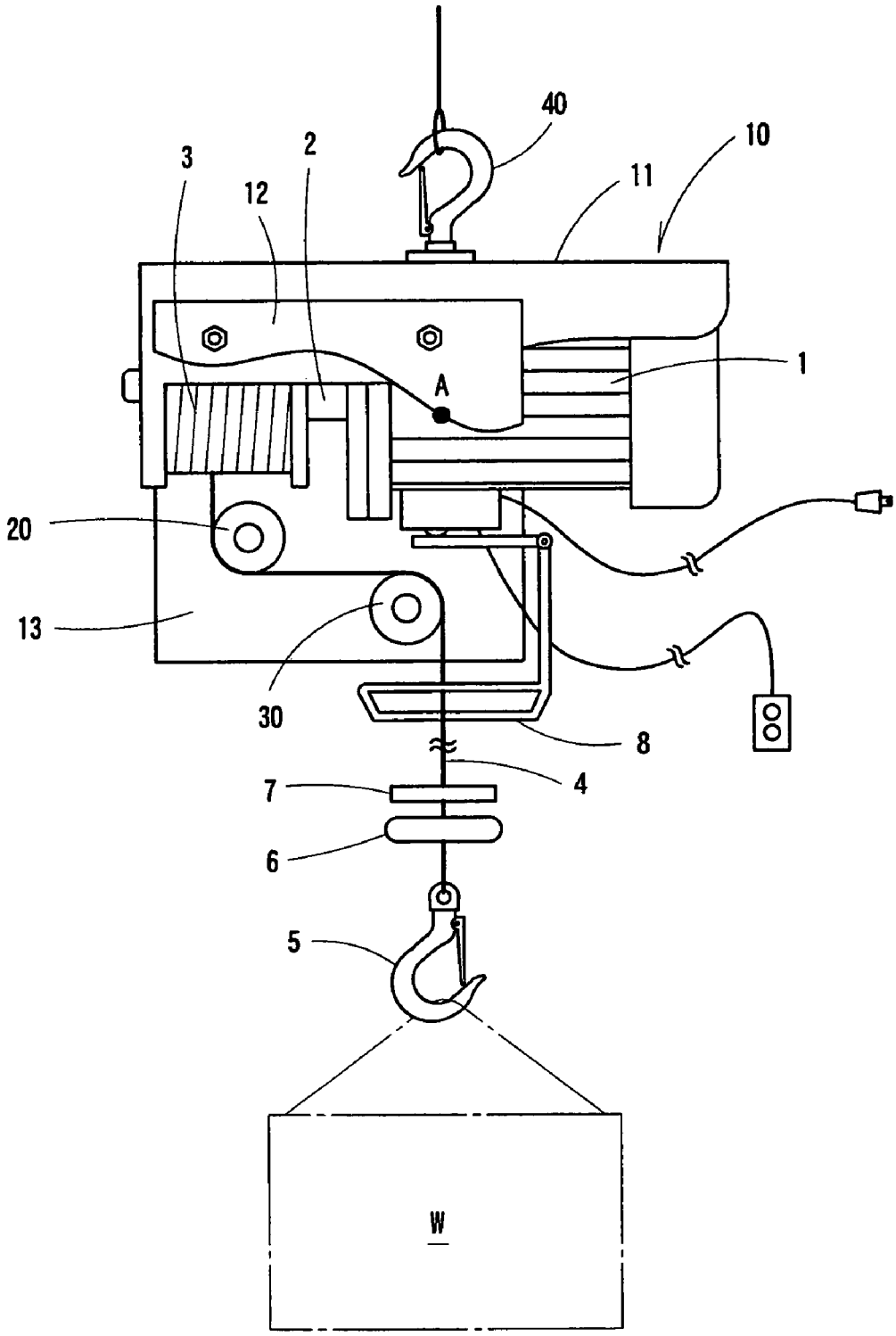
FIG. 1 is a front view of an entire hoist in accordance with a first preferred embodiment of the present invention with a portion of the hoist broken away.
Figure 2:
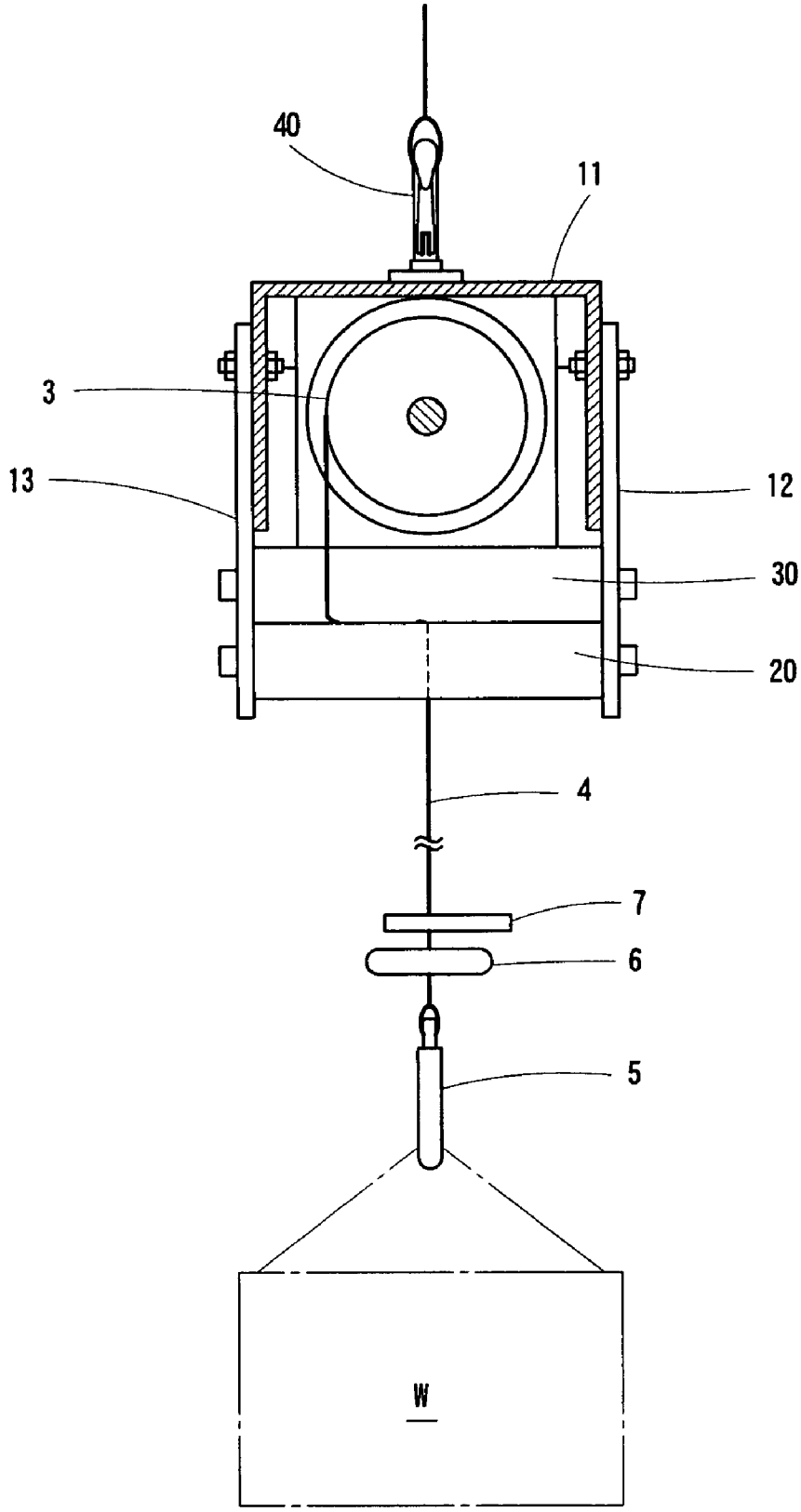
FIG. 2 is a side view of the hoist.
Figure 3:
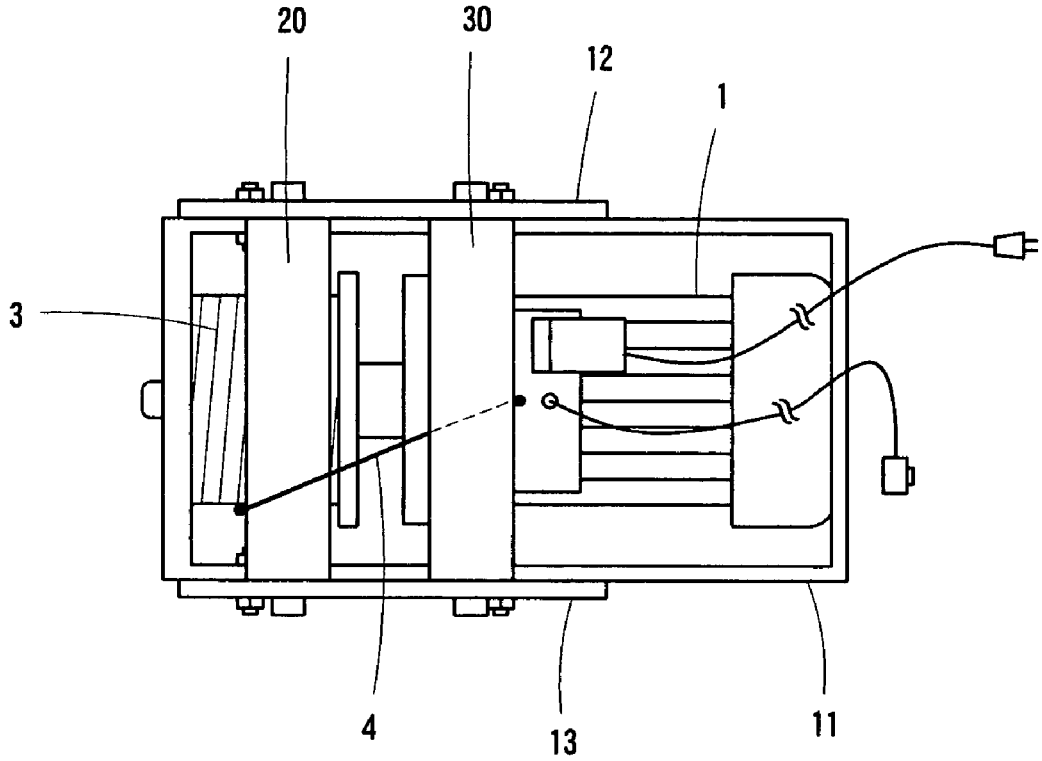
FIG. 3 is a bottom view of the hoist.

The preferred embodiments of the present invention are discussed with reference to the drawings. An electric winch 10 includes an electric motor 1 and a drum 3. The drum 3 is axially connected to a drive shaft 2 of the electric motor 1. Optionally, a reduction mechanism is arranged between the drive shaft 2 of the electric motor 1 and the drum 3. When the electric motor 1, for example, a geared motor, rotates, the drum 3 rotates. A wire 4 is paid out from the drum 3 or wound up around the drum 3. A hook 5 is attached to the end of the wire 4. A cover frame 11, which has already been discussed in the Description of the Related Art section, is attached to the electric winch 10. The cover frame 11 has a box-like structure with the lower portion thereof opened. A front plate 12 and a rear plate 13 are bolted to the front and the back of the cover frame 11. The front plate 12 and the rear plate 13 are not necessarily separate elements and may be integrally extended from the cover frame 11. A first roller 20 and a second roller 30 extend between the front plate 12 and the rear plate 13.

A weight 6 and a stopper 7 are attached to the end of the wire 4. The weight 6 gives weight to the wire 4 even in an empty load condition to cause the wire 4, wound around the first roller 20 and the second roller 30, to be downward suspended in a vertically aligned direction. The stopper 7 prevents the wire 4 from being overwound by abutting an upper limit lever 8 having a limit switch during a load raising operation. The upper limit lever 8 also controls excessive swinging of the wire 4 in the fore-aft direction. One of the weight 6 and the stopper 7 may also serve the function of the other and one or both of the weight 6 and the stopper 7 may be dispensed with.

In the first preferred embodiment, let A represent the center gravity of all elements including the electric winch 10, the cover frame 11, the front plate 12, the rear plate 13, the first roller 20, the second roller 30, the weight 6, the stopper 7, the upper limit lever 8, and the hook 5. Since the electric motor 1 is heavier than the drum 3 in the electric winch 10, the center A of gravity may be shifted laterally closer to the electric motor 1. The suspension hook 40 is fixed to the cover frame 11 right above the center A of gravity. The suspension hook 40 may be a ring or may have any other shape. It is important to suspend the hoist. From this point of view, the suspension hook 40 may be directly attached to the electric winch 10 without the cover frame 11.

The hoist of the preferred embodiments of the present invention includes the electric winch 10, the cover frame 11, the front plate 12, the rear plate 13, the first roller 20, the second roller 30, the weight 6, the stopper 7, the upper limit lever 8, the hooks 5 and 40.

The wire 4 paid out from the drum 3 is wrapped around the lower half of the first roller 20 and then runs to join the line extending downward from the center A of gravity. The wire 4 is then wrapped around the upper portion of the second roller 30 and runs downward. The mounting position of the second roller 30 with respect to the front plate 12 and the rear plate 13 is determined so that the vertically aligned wire 4 is right below the suspension hook 40. As a result, the hook 5 and the suspension hook 40 are aligned with the center A of gravity of the entire hoist in a vertically aligned line.

The hoist thus constructed is laterally balanced in the empty load condition when the entire hoist is suspended using the suspension hook 40. Even when a load is suspended on the hook 5, the hook 5 and the wire 4 are positioned right below the suspension hook 40, in other words, are aligned with the center A of gravity of the entire hoist in a vertically aligned line. The balance of the hoist and the load are laterally balanced. The weight of the load has no effect on this balance. In accordance with the present invention, a general-purpose electric winch may be used as an electric winch. Regardless of the empty load condition or loaded condition, the hoist is laterally balanced.

Figure 4:
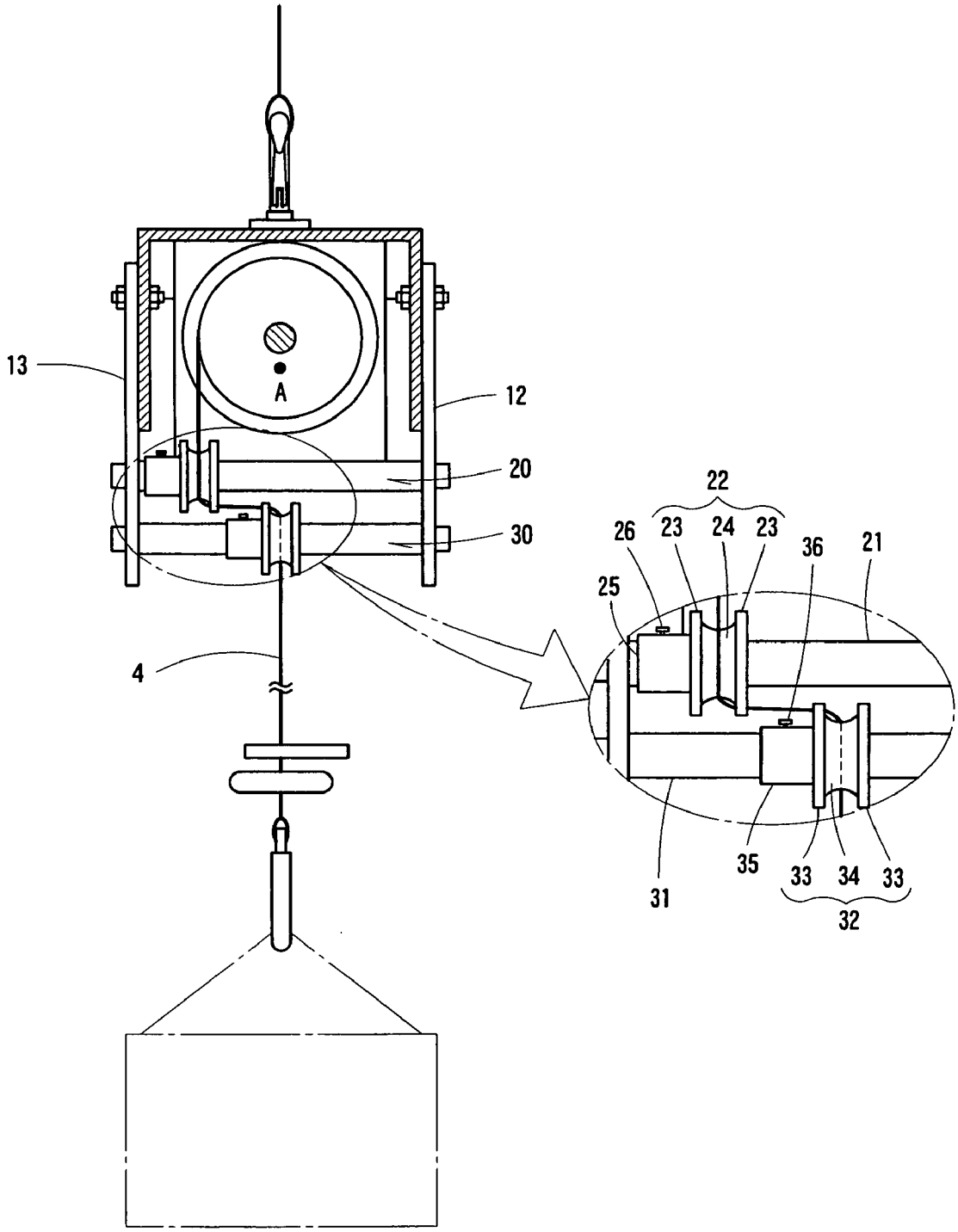
FIG. 4 is a side view of a hoist in accordance with a second preferred embodiment of the present invention.

The hoist has been discussed in terms of the lateral balance. A second preferred embodiment of the present invention taking into consideration of fore-aft balance will now be discussed. As shown in FIG. 4, a first roller 20 includes a cylindrical shaft 21 and a sheave 22 supported on the cylindrical shaft 21. A second roller 30 includes a cylindrical shaft 31 and a sheave 32 supported on the cylindrical shaft 31. The cylindrical shaft 21 and the cylindrical shaft 31 are rotatably supported at and between a front plate 12 and a rear plate 13 of a cover frame 11. The sheave 22 includes a groove 24 between opposed flanges 23 thereof and the sheave 32 includes a groove 34 between opposed flanges 33 thereof. The groove 24 and the groove 34 receive the wire 4. An extension cylinder 25 is extended from the flange 23 on one side, and an extension cylinder 35 is extended from the flange 33 on one side. A screw 26 driven through the extension cylinder 25 secures the sheave 22 onto the cylindrical shaft 21. A screw 36 driven through the extension cylinder secures the sheave 32 to the cylindrical shaft 31. In this arrangement, the sheave 22 rotates integrally with the cylindrical shaft 21 and the sheave 32 rotates integrally with the cylindrical shaft 31. The first roller 20 and the second roller 30 are identical in structure.

In the first roller 20, the sheave 22 is aligned in position with respect to the cylindrical shaft 21 as below. The sheave 22 is located so that the wire 4 paid out from the drum 3 is in a direction tangential to the groove of the sheave 22. High precision is not required of the position of the sheave 22 as long as the first roller 20 causes the wire 4 paid out from the drum 3 to run to join the line vertically extending from the center of gravity. The sheave 32 of the second roller 30 is positioned with respect to the cylindrical shaft 31 so that the wire 4 running down along the sheave 32 extends vertically downward immediately below the center A of gravity.

In accordance with the second preferred embodiment, the wire 4 downward paid out from the sheave 32 of the second roller 30 comes right below the center A of gravity of the entire hoist in the fore-aft direction. The hoist is thus balanced in the fore-aft direction during the empty load period and loaded period. The sheaves 22 and 32 control the swinging motion of the wire 4. Since the sheaves 22 and 32 are fixed by the screws 26 and 36 respectively, the sheaves 22 and 32 are fixed on the cylindrical shafts 21 and 31. As a result, a stable cargo handling operation is assured.

Figure 5:
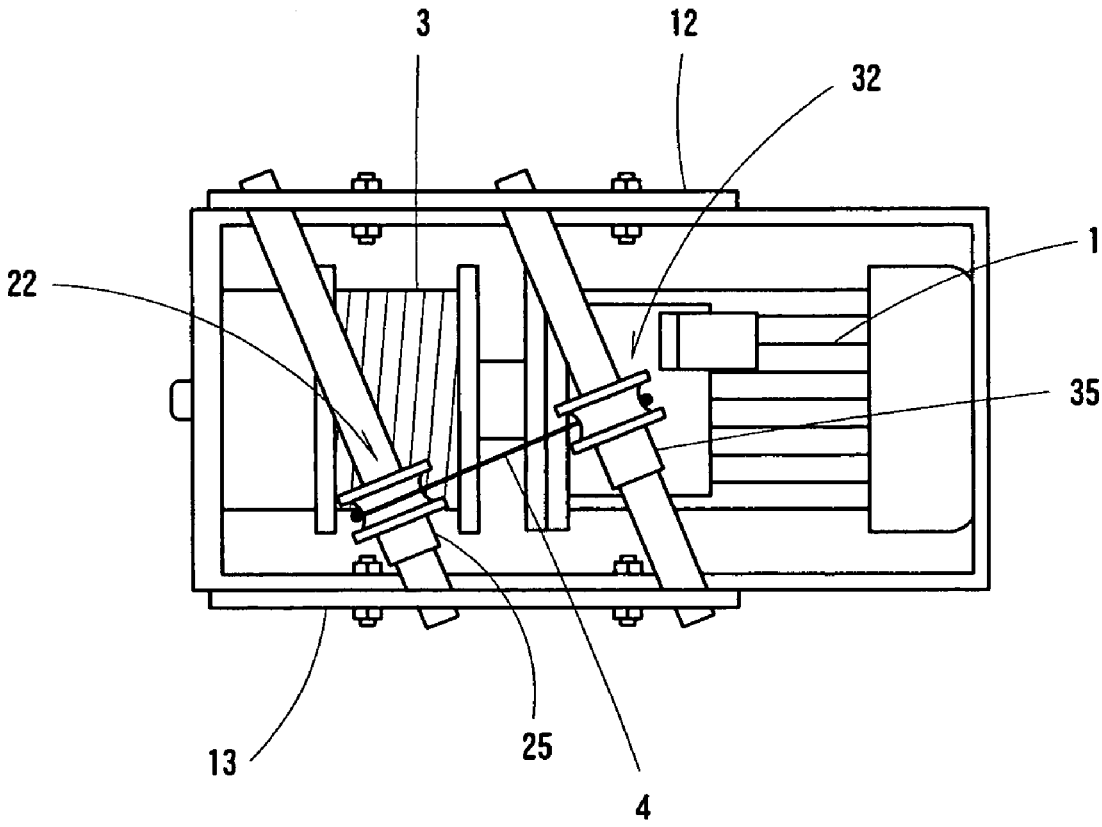
FIG. 5 is a bottom view of a hoist in accordance with a third preferred embodiment of the present invention.

With the sheaves 22 and 32 positioned in the first and second rollers 20 and 30 respectively, the wire 4 is obliquely stretched between the sheaves 22 and 32. The screws 26 and 36 prevent the sheaves 22 and 32 from sliding on the cylindrical shafts 21 and 31 respectively. The wire 4 rubs against flanges 23 and 33 of the sheaves 22 and 32 between the sheaves 22 and 33. As the load is heavier, resulting friction of the wire 4 to the flanges increases more possibly leading to an accidental cutting of the wire 4. In a third preferred embodiment, the following means is incorporated. Referring to FIG. 5, the alignment of the sheaves 22 and 32 is adjusted so that a line connecting the grooves 24 and 34 of the sheaves 22 and 32 is aligned with the wire 4 in inclination angle. More specifically, the cylindrical shafts 21 and 31 are mounted on the front plate 12 and the rear plate 13 at a slant angle with respect to the front plate 12 and the rear plate 13. The angle is set so that the cylindrical shafts 21 and 31 are at a right angle with respect to the wire 4. In this way, the wire 4 is stretched in correct alignment between the groove 24 of the sheave 22 and the groove 34 of the sheave 32. The wire 4 is free from rubbing against the flanges 23 of the sheave 22 and the flanges 33 of the sheave 32. With no undue force applied, the wire 4 is prevented from being bent. The cutting of the wire 4 due to frictions is thus avoided. Since the friction to the sheaves 22 and 32 is reduced, burden on the electric motor 1 is reduced.

Figure 6:
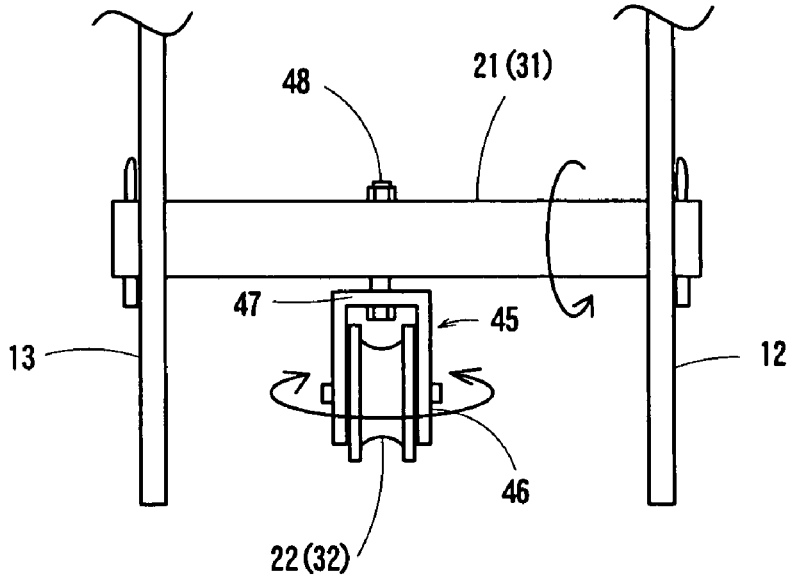
FIG. 6 is a side view of a hoist in accordance with a fourth preferred embodiment of the present invention.

A fourth preferred embodiment of the present invention will now be discussed with reference to FIG. 6. The fourth preferred embodiment relates to improvements over the third preferred embodiment and causes the sheaves 22 and 32 to follow the motion of a load during the cargo handling operation. The load is not always stabilized in posture during the cargo handling operation. The load may be laterally swung or may be hauled by humans at a slant angle with respect to the vertical direction. Such a motion causes the wire 4 to swing, thereby applying an undue force to the wound position of the wire 4 in the sheaves 22 and 32 (in particular in the sheave 32 that changes the direction of the wire 4 a vertically downward direction). In the fourth preferred embodiment, the sheave 22 is supported at a square U-shaped bracket 45 which is fixed to the cylindrical shaft 21 that is rotatably supported by the front plate 12 and the rear plate 13 of the cover frame. The sheave 32 is supported at a square U-shaped bracket 45 that is fixed to the cylindrical shaft 31 that is rotatably supported by the front plate 12 and the rear plate 13 of the cover frame. Lower ends 46 of the square U-shaped bracket 45 supports the rotary shaft of each of the sheaves 22 and 32. The square U-shaped bracket 45 on the upper portion 47 thereof is rotatably connected to the cylindrical shaft 21 by a connection shaft 48, such as a bolt and nut, inserted through the cylindrical shaft 21. The other U-shaped bracket 45 on the upper portion thereof is rotatably connected to the cylindrical shaft 31 by a connection shaft 48, such as a bolt and nut, inserted through the cylindrical shaft 31. The sheaves 22 and 32 automatically align themselves in response to the swinging of the load, and as a result, the winding position of the wire 4 with respect to the sheaves 22 and 42 is optimized. Although the sheave 22 only is shown, the other sheave 32 is equally installed. The mounting positions of the sheaves 22 and 32 with respect to the cover frame and the winding position of the wire 4 remain unchanged from those in the third preferred embodiment. The bracket 45 is not limited to the U-shaped configuration. Alternatively, the bracket 45 may take an L-shape or other configuration as long as the bracket 45 is rotatably supported by the sheaves 22 and 32.

Figure 7:
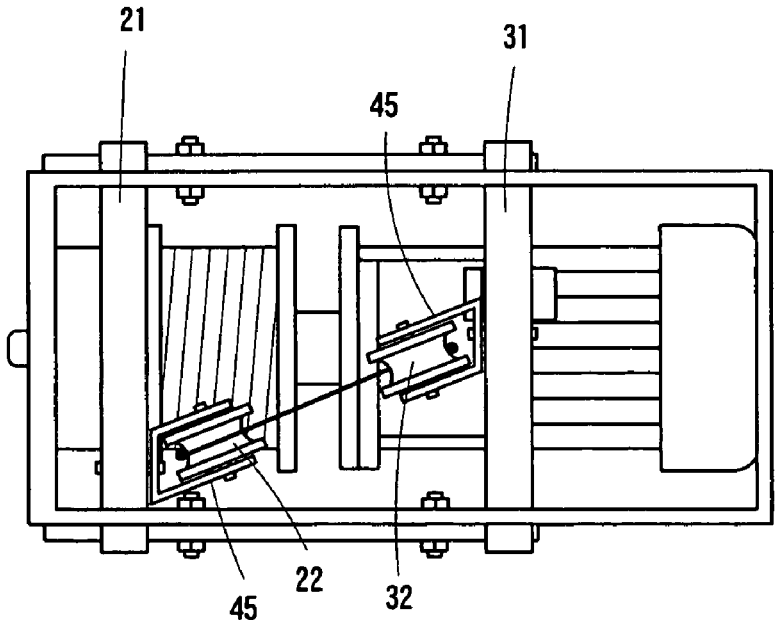
FIG. 7 is a side view of a hoist in accordance with a fifth preferred embodiment of the present invention.
Figure 8:
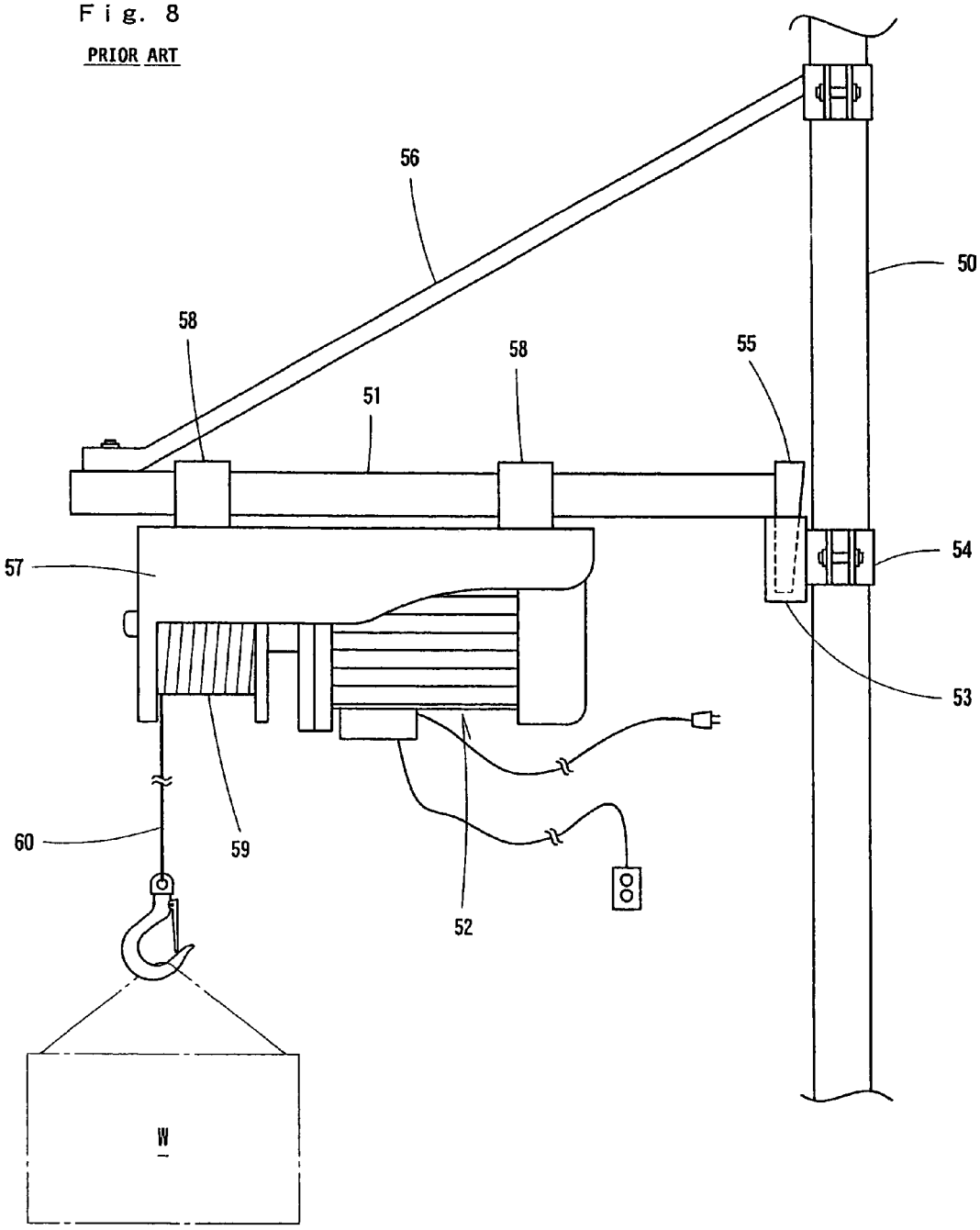
Fig. 8 PRIOR ART
FIG. 8 is a front view generally illustrating a known hoist.
Figure 9:
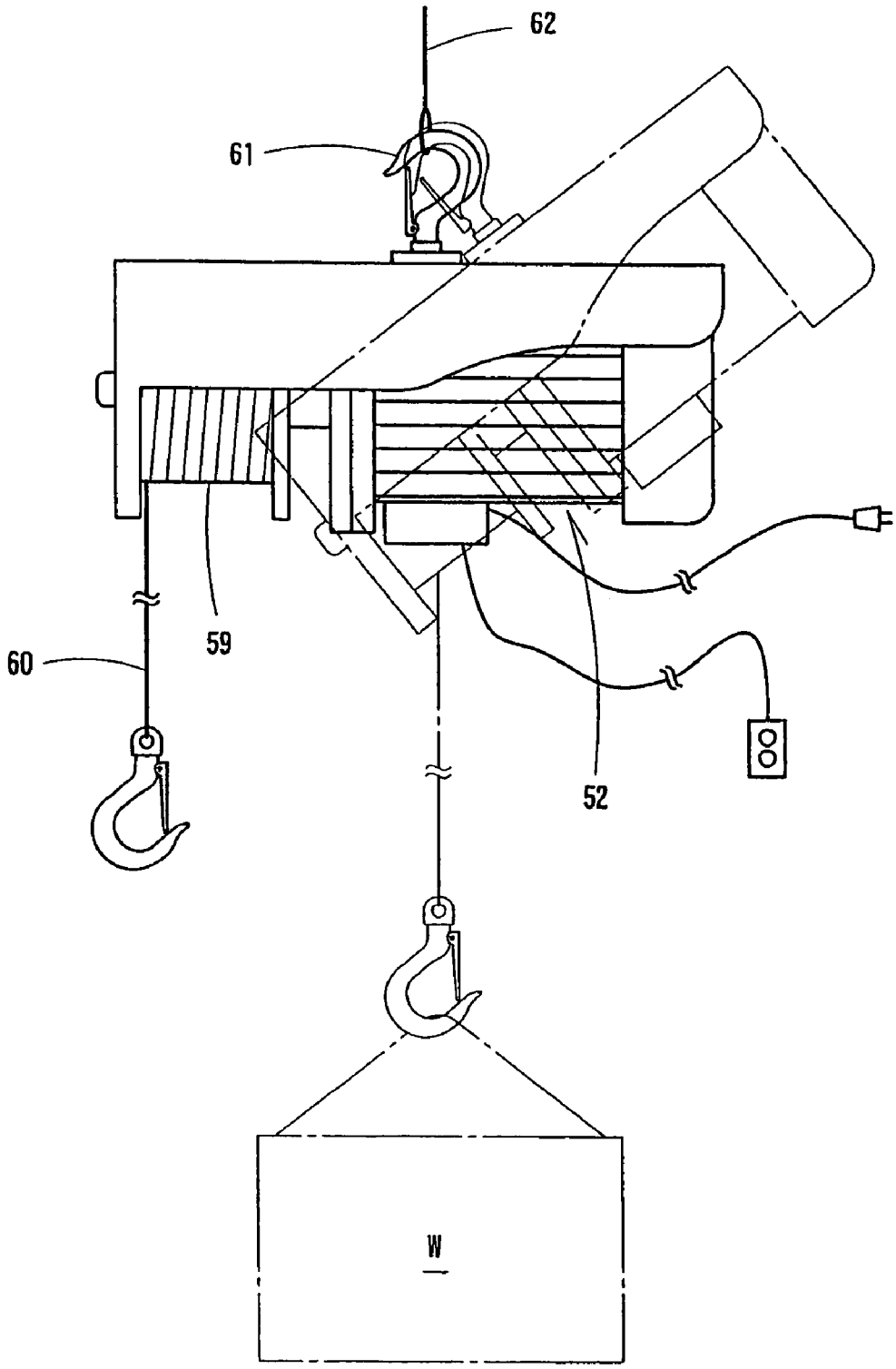
Fig. 9 PRIOR ART
FIG. 9 is a front view generally illustrating a known hoist.

FIG. 7 illustrates a fifth preferred embodiment. The bracket 45 of each of the sheaves 22 and 32 is tilted at a predetermined angle so that a line connecting the grooves of the sheaves 22 and 32 are aligned with the wire 4 stretched between the sheaves 22 and 32. More specifically, the tilt angle of the bracket 45 is set to be equal to the inclination angle of the wire 4 with respect to the cylindrical shafts 21 and 31. In other words, the wire 4 is set to be perpendicular to the shaft of each of the sheaves 22 and 32. Like in the third preferred embodiment, the wire 4 is correctly stretched between the groove 24 of the sheave 22 and the groove 34 of the sheave 42. The wire 4 is free from rubbing against the flanges 23 of the sheave 22 and the flanges 33 of the sheave 32. With no undue force applied, the wire 4 is prevented from being bent. The cutting of the wire 4 due to frictions is thus avoided. Since the friction to the sheaves 22 and 32 is reduced, burden on the electric motor 1 is reduced. The use of the bracket 45 fixed in the tilted position thereof allows the cylindrical shafts 21 and 31 to be mounted without any inclination, thereby resulting in a mechanically stronger structure. The follow-up characteristics of the sheaves 22 and 32 to the swinging of the wire 4 and the mounting of the cylindrical shafts 21 and 31 to the cover frame remain identical to the fourth preferred embodiment.

Both a rope and a chain fall within the category of the wire 4 in the context of the present invention. Both an electric motor and a geared motor fall within the category of the electric motor 1.

INDUSTRIAL APPLICABILITY

In accordance with the present invention, the electric winch is suspended in the simplest suspension method when the electric winch is used as the electric hoist. The suspension method is implemented in many plants and warehouses without any particular facility. The electric winch in the suspended posture thereof is balanced in a fore-after direction and a lateral direction, and continuously maintains a horizontal aligned posture during a load empty period and a load raising and lowering period. A cargo handling operation using the electric winch is safely performed. Since the position of the first and second roller for causing the wire paid out from the drum to run vertically downward right below the center of gravity is adjusted, no excessive friction takes place between the wire and the rollers. No increase in the burden on the motor occurs.

What is claimed is:

1. An electric hoist comprising an electric winch including a drum axially connected to a drive shaft of a motor, a suspension hook attached to said electric winch right above the center of gravity of said electric winch, said electric winch being in a horizontal posture in an empty load state thereof, a first roller arranged on the opposite side of said electric winch from said suspension hook and turning the direction of a wire paid out from the drum toward the center of gravity, and a second roller for turning the direction of the wire to be aligned with a vertical line downward extended from the center of gravity of said electric winch.

2. An electric hoist according to claim 1, wherein each of said first and second rollers comprises a rotary shaft and a sheave secured on said rotary shaft.

3. An electric hoist according to claim 2, wherein said sheave is secured to said rotary shaft using a screw.

4. An electric hoist according to claim 2, wherein said sheave of said first roller and said sheave of the second roller are arranged at an angle equal to the angle of inclination of the wire stretched between said two sheaves.

5. An electric hoist according to claim 4, wherein said rotary shaft is set to be at a right angle to said wire stretched between the sheaves.

6. An electric hoist according to claim 2, wherein said sheave that turns said wire to a vertically downward direction is rotatably supported around said rotary shaft thereof.

7. An electric hoist according to claim 6, wherein each of said sheaves is arranged on a respective one of said rotary shafts at an angle with respect to the respective rotary shafts so that said wire stretched between said sheaves is aligned with said sheaves.

8. An electric hoist according to claim 1, wherein a weight is attached to one end of said wire.

9. An electric hoist according to claim 1, wherein a stopper is attached to one end of said wire.

* * * * *